US007322383B2

(12) United States Patent
Gesing

(10) Patent No.: US 7,322,383 B2
(45) Date of Patent: Jan. 29, 2008

(54) HEALD FRAME ROD COMPRISING A DISPLACEABLE HEALD DAMPING ELEMENT

(75) Inventor: Karl-Heinz Gesing, Raesfeld (DE)

(73) Assignee: Groz-Beckert KG, Albstadt (DE)

( * ) Notice: Subject to any disclaimer, the term of this patent is extended or adjusted under 35 U.S.C. 154(b) by 63 days.

(21) Appl. No.: 10/561,846

(22) PCT Filed: Jun. 22, 2004

(86) PCT No.: PCT/EP2004/006737

§ 371 (c)(1),
(2), (4) Date: Dec. 22, 2005

(87) PCT Pub. No.: WO2005/001179

PCT Pub. Date: Jan. 6, 2005

(65) Prior Publication Data

US 2006/0137759 A1 Jun. 29, 2006

(30) Foreign Application Priority Data

Jun. 28, 2003 (DE) ..... 103 29 219

(51) Int. Cl.
*D03C 9/06* (2006.01)
*D03C 9/00* (2006.01)

(52) U.S. Cl. ..... 139/89; 139/91; 139/92; 139/93

(58) Field of Classification Search ..... 139/91, 139/92, 89, 93
See application file for complete search history.

(56) References Cited

U.S. PATENT DOCUMENTS 2,461,496 A 2/1949 Kaufmann
3,895,655 A * 7/1975 Sujdak et al. ..... 139/92
4,106,530 A * 8/1978 Kaufmann ..... 139/92
6,009,918 A * 1/2000 Beyaert ..... 139/92
6,230,756 B1 * 5/2001 Baumann et al. ..... 139/93
6,789,580 B1 * 9/2004 Cardoen et al. ..... 139/92

(Continued)

FOREIGN PATENT DOCUMENTS

CH 588 582 6/1977

(Continued)

OTHER PUBLICATIONS

Patent Abstracts of Japan, vol. 1998, No. 05, Apr. 30, 1998.

*Primary Examiner*—Gary L. Welch
*Assistant Examiner*—Robert H Muromoto, Jr.
(74) *Attorney, Agent, or Firm*—Norman N. Kunitz; Fitch, Even, Tabin & Flannery

(57) ABSTRACT

A heald (heddle) shaft (1) comprises at least one shaft rod (2) on which a damping element (12)is supported on the shaft rod carrier body (15) to be movable in the longitudinal direction of a heald or heddle (8) mounted on a shaft stave or rail (6) carried by the body (15) so as to be moveable toward and away from an abutment surface (26) of the support body (15) and an outer end surface (22) an eyelet of a heald or heddle (8) mounted on the shaft stave (6). By virtue of movably supporting the damping element (12), an alignment of the healds or heddles (8) is improved and facilitated, and a desired damping effect is obtained during the entire motion course of the healds or heddles (8).

15 Claims, 6 Drawing Sheets

U.S. PATENT DOCUMENTS

| | | | | |
|---|---|---|---|---|
| 6,883,554 | B2 * | 4/2005 | Baumann et al. | 139/93 |
| 6,981,527 | B2 * | 1/2006 | Froment | 139/93 |
| 6,994,122 | B2 * | 2/2006 | Cardoen et al. | 139/91 |
| 7,036,532 | B2 * | 5/2006 | Bauder et al. | 139/52 |
| 7,147,010 | B2 * | 12/2006 | Froment et al. | 139/91 |
| 7,185,679 | B2 * | 3/2007 | Schwemmlein et al. | 139/93 |
| 7,204,274 | B2 * | 4/2007 | Mettler | 139/93 |
| 2003/0150506 | A1 * | 8/2003 | Baumann et al. | 139/93 |

FOREIGN PATENT DOCUMENTS

| | | | |
|---|---|---|---|
| EP | 1 176 237 | A1 | 1/2002 |
| JP | 10 001844 | A | 1/1998 |
| WO | WO-97/26396 | | 7/1997 |
| WO | WO-01-48284 | A1 | 7/2001 |
| WO | WO-2004/057076 | A1 | 7/2004 |
| WO | WO-2004/057077 | A1 | 7/2004 |

* cited by examiner

HEALD FRAME ROD COMPRISING A DISPLACEABLE HEALD DAMPING ELEMENT

CROSS REFERENCE TO RELATED APPLICATION

This application is the National Stage filing under 35 U.S.C. 371 of International Application No. PCT/EP2004/006737, filed Jun. 22, 2004, and claims priority of German Patent Application 103 29 219.5, filed Jun. 28, 2003.

BACKGROUND OF THE INVENTION

The invention relates to a shaft rod, particularly for a heald shaft of a weaving machine, and includes the features of the preamble of claim 1. The invention further relates to a heald shaft provided with at least one of such a shaft rod.

Heald shafts of weaving machines are, as a rule, formed of a rectangular frame whose long sides are constituted by so-called shaft rods. Each shaft rod supports a shaft stave. Between the mutually parallel-arranged shaft staves healds are disposed which, by means of their end eyelets, are attached to the shaft staves. Each heald has at least one thread eyelet through which a warp thread extends which is moved by the motion of the heald shaft for shed forming. The healds are held on the shaft staves with a certain longitudinal play to enable them to freely align themselves in the lateral direction and to prevent them for being either compressed or extended. Such a play causes a continuous pounding or clattering of the healds against the shaft staves, creating a source of noise. Further, a stress on the healds is generated which may lead to heald breakage.

WO 01/48284 A1 discloses a heald shaft for a weaving machine. The shaft rods of the heald shaft each have a damping element on their sides facing the end eyelets of the healds. The damping element is arranged within the play range of the end eyelet, so that the latter may abut the damping element. Upon impact on the material having damping properties, lesser noise and mechanical stress on the heald are generated than in case of hard abutments.

The above principle is also realized according to U.S. Pat. No. 3,895,655 and Swiss Patent 588582.

Rubber or the like is being considered as the damping material. In the course of the threading step, the healds stand with their end eyelets on the lower damping element and remain suspended there by frictional engagement. Such a circumstance renders the thread-in of the healds more difficult. This is aggravated if a relatively small play is provided between the lower end eyelet and the damping element for the purpose of limiting the back-and-forth pounding of the healds in their longitudinal direction. If, on the other hand, a large play is provided for the operation, the damping effect remains limited.

It is therefore an object of the invention to provide a shaft rod which ensures a low-noise operation. It is further an object of the invention to provide a method of outfitting a heald shaft which includes at least one shaft rod as described above and where the thread-in of the healds may be effected in a manner as uncomplicated as possible.

SUMMARY OF THE INVENTION

The above objects generally are achieved according to a first aspect of the invention with a shaft rod, particularly for a heald or heddle shaft of a weaving machine, including:

a carrier body which carries a shaft stave or on which a shaft stave is formed, at least one heald damping element supported on the carrier body, and wherein the heald damping element is supported to be movable transversely to the carrier body.

The above objects generally are achieved according to a second aspect of the invention with a method of fitting a heald shaft with healds or heddles and/or threading threads into the healds, wherein the fitting step and/or the threading step is performed on a heald shaft; with the damping element from at least one shaft rod of the heald shaft having been removed, and after completing the fitting and/or the threading step, the damping element is mounted on the shaft rod.

The shaft rod according to the invention comprises a damping element which is arranged in the vicinity of the shaft stave and which is transversely movably supported on the shaft rod. Thus, the damping element is supported for displacement in the longitudinal direction of the healds. Such an arrangement results in a reduction of the wear between the shaft stave and the healds. The heald motion is damped very effectively. Further, the damping measure avoids heald breakages and results in a noise reduction.

It is essential in the inventive shaft rod having a movable damping element that the healds be entrained, that is, pulled, by the shaft staves, and that during the entire motion process, a damping element lie on the healds by virtue of gravity affecting the element or by virtue of inertia. At the same time, the healds are freely movably supported and are damped only by the weight of the damping element. At the points of reversal of the direction of motion of the heald shaft, the damping elements assume, possibly briefly, a pushing function due to their elasticity. At the reversal points the healds slightly penetrate into the damping elements, so that the healds are gently, rather than abruptly braked to thereafter continue their motion in the opposite direction.

The loose support of the damping element on the shaft rod provides for the possibility of facilitating the fitting of the heald shaft with the healds. The damping element is not held fixedly on the heald shaft and thus may also move in the axial direction. This applies at least if, as preferred, the damping element has a constant cross section along its length. As a result, the heald shaft may be fitted with healds when the damping element is still absent during such a step. First, the warp threads may be threaded into the healds by a threading machine and thereafter the damping element is inserted into he heald shaft. The corresponding process steps are defined in the method claim.

The damping element is, for performing the process, preferably releasably connected to the heald shaft, that is, it is removably held thereon. It may be removed from its seat, for example, by a slight elastic deformation. In such an embodiment no longitudinal mobility of the damping element is required. It is, however, also possible, to pull the damping element longitudinally into its seat.

Further, the movable damping element provides for a reduction of the oscillations of the healds during operation of the weaving machine. This may lead to an improved appearance of the fabric. An oblique positioning of the healds as well as warp thread ruptures are prevented during operation.

In addition, the operating speed of the weaving machine and thus its productivity may be increased.

Further details of advantageous embodiments appear in the drawing, the description and the claims.

BRIEF DESCRIPTION OF THE DRAWINGS

In the drawing, which illustrates examples of embodiments of the invention.

DETAILED DESCRIPTION OF THE INVENTION

Figure 1:
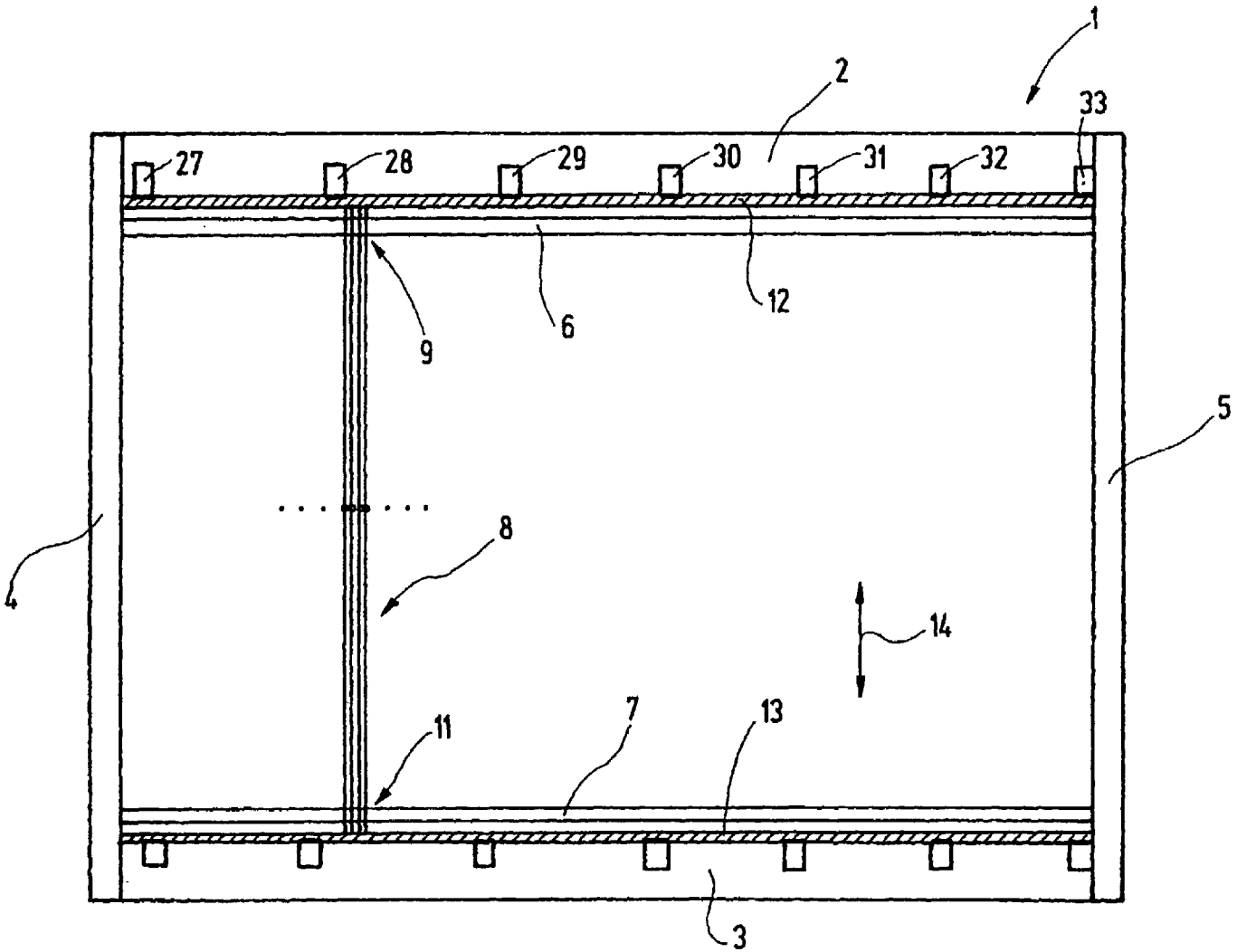
FIG. 1 is a schematic front view of a heald shaft.
Figure 2:
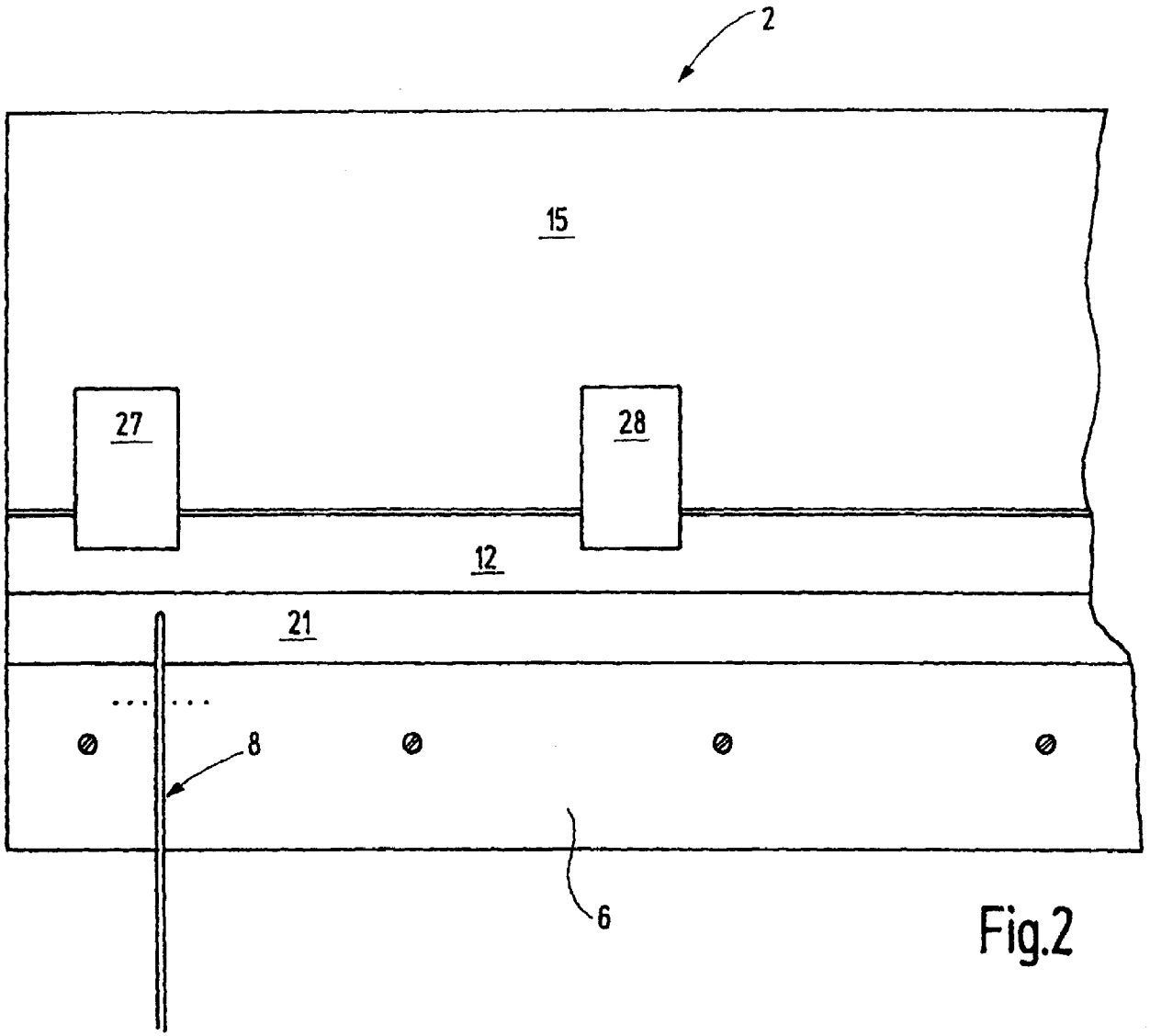
FIG. 2 is a fragmentary schematic front view of a shaft rod of the heald shaft of FIG. 1, shown with a heald.

FIGS. 1 and 2 illustrate a heald shaft 1 forming part of a weaving machine. The heald shaft is composed of an upper shaft rod 2, a lower shaft rod 3 extending parallel to the upper shaft rod 2 and end binders 4, 5 connecting the shaft rods 2, 3 with one another. The shaft rods 2, 3 and the end binders 4, 5 define a rectangular frame.

The shaft rod 2 and the shaft rod 3 hold a respective shaft stave 6, 7 extending parallel to the respective shaft rod 2, 3. The shaft staves 6, 7 are flat, steel profile members, while the shaft rods 2, 3 are preferably extruded aluminum profile members. The heald shaft 1 has many, mutually parallel-arranged healds 8 which sit on the shaft staves 6, 7 by means of their end eyelets 9, 11.

At least at one, but preferably at both shaft rods 2, 3, respective damping elements 12, 13 are arranged in the immediate vicinity of the end eyelets 9, 11. The damping elements 12, 13 are supported on the shaft rods 2, 3 for displacement in the working direction of the heald shaft 1 as indicated by the arrow 14 in FIG. 1. The working direction corresponds to the longitudinal direction of the end binders 4, 5 and the healds 8.

In the present embodiment the shaft rods 2, 3 are of identical structure. For this reason, in the description which follows, only the shaft rod 2 will be discussed to represent both the shaft rods 2 and 3.

Figure 3:
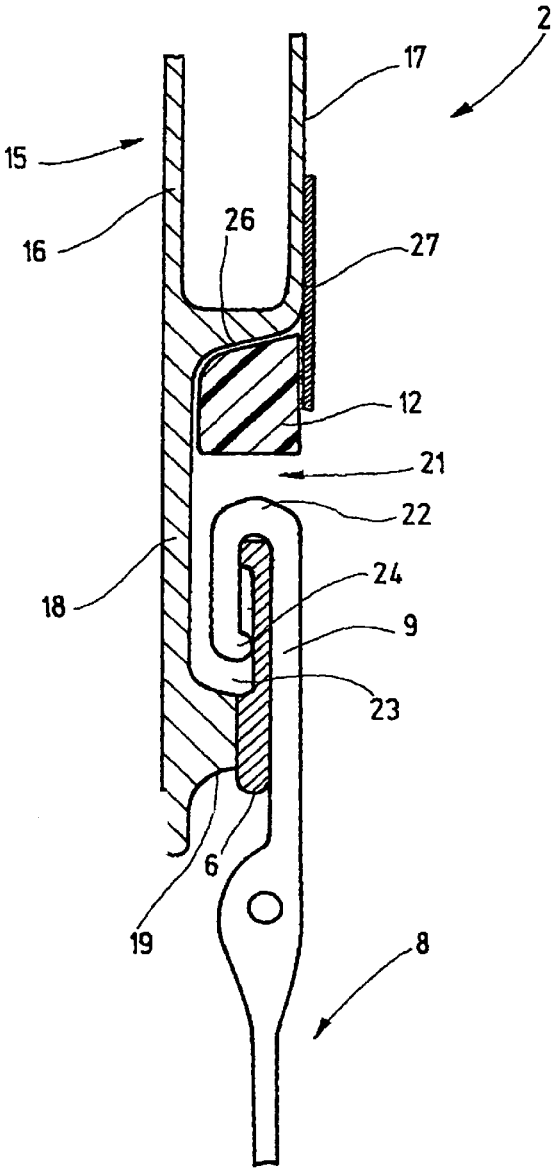
FIGS. 3 and 4 are schematic, fragmentary cross-sectional illustrations of a first embodiment of a shaft rod having a movable damping element, shown in different positions of the damping element.
Figure 4:
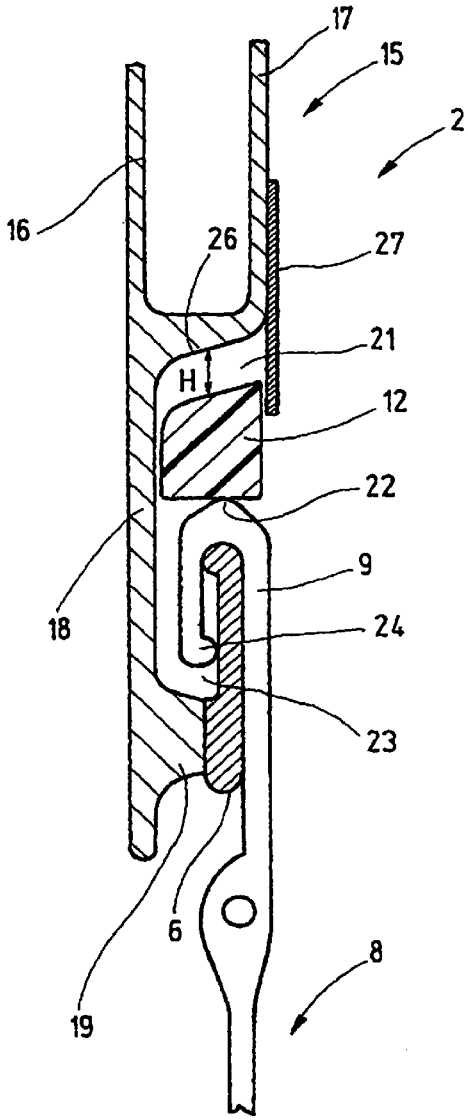

The shaft rod 2 illustrated in FIGS. 3 and 4 has a box-profile shaped carrier body 15 extending along the entire length of the shaft rod 2 and preferably having a constant cross section. The carrier body 15 has, for example, in its direction of motion, a narrow, upstanding rectangular profile having two side walls 16, 17. A plate-like securing web 18 extends away from the underside of the carrier body 15 as a linear continuation of the side wall 16. The securing web 18, for example, forms a single-piece component with the carrier body 15. On one of the flat sides of the securing web 18 a strip-like projection 19 is formed for carrying the shaft stave 6. The latter extends parallel to the carrier body 15 and is located underneath the lower narrow side thereof. Between the lower narrow side of the carrier body 15 and the shaft stave 6 a buffer chamber 21 is formed into which extends the head 22 of the upper end eyelet 9 of the heald 8. The head is formed by a portion of the end eyelet 9, bent in a U shape and straddling the shaft stave 6. In the present embodiment the shaft stave 6 is, at its side oriented toward the securing web 18, provided with a wide, groove-like longitudinal recess 23 into which a holding lug 24 of the end eyelet 9 extends. The width of the longitudinal recess 23 minus the width of the holding lug 24 defines the longitudinal play of the heald 8. Such longitudinal play, however, may also be differently defined or limited.

In the buffer chamber 21 a damping element 12 is arranged which may be, for example, a cross-sectionally trapezoidal bar made of a damping material, such as plastic, a foam plastic, a plastic provided with hollow spaces, a synthetic fiber body or the like. The damping element may also be a bar or a strip made of a composite material (such as a metal-plastic composite, for example, a steel core having a plastic jacket), a jacketed foam body or a jacketed fiber body. The contour of the damping element conforms to the buffer chamber 21. At its side facing the planar securing web 18, the damping element has a planar surface. The carrier body 15 has, externally at its underside, an oblique engagement surface 26. At that location the damping element 12 has an engagement surface which too, is arranged obliquely, that is, at an obtuse angle to the securing web 18. The damping element 12 has likewise a planar surface at its outer side which is oriented parallel to the side wall 17. At the side facing the head 22, the damping element 12 may be provided with a strip-shaped planar surface or, if required, it may have a convexly or concavely bent surface. It is of importance that the largest possible distance shown in FIG. 3 between the damping element 12 and the head 22 is less than the maximum play of the head 9 on the shaft stave 6. Furthermore, the damping element 12 is movably supported in such a manner that, as shown in FIG. 4, it may lie on the heads 22 of the healds 8 by virtue of its own weight and occasionally by its inertia, even if the healds 8 are at their maximum distance from the carrier body 15. These conditions, namely the circumstance that, on the one hand, the distance between the damping element 12 and the head 22 of the heald 8 is less than the play of the heald 8 on the shaft staves 6, 7 and, on the other hand, the damping element 12 lies on the heads 22 by virtue of gravity, lead to a damping of the healds 8 during upward and downward motion and at the points of reversal of the direction of motion. In case the distance between the damping element 12 and the head 22 of the heald 8 is greater than the play of the heald 8 on the shaft staves 6, 7, then the heald is, according to the invention, damped during upward and downward motion of the heald shaft 1 by virtue of the engagement of the damping element 12 with the healds.

In order to hold the damping element 12 securely in the buffer chamber 21, the shaft rod 2 is, for example at its side wall 17, provided with sheet metal securing members 27 to 33 (FIG. 1) which may be glued to the outside of the side wall 17. The sheet metal securing members 27 to 33 extend beyond the engagement surface 26 by a distance which is greater than the maximum stroke H (FIG. 4) of the damping element 12. The stroke H is obtained from the distance measured from the upper edge of the shaft stave 6 to the engagement surface 26 minus the height of the damping element 12 and the height of the head 22. The sheet metal securing members 27 to 33 thus straddle the damping element 12, even if the latter is situated in its lowest position (FIG. 4).

The heald shaft 1 as described above, operates as follows:

Before use, the heald shaft 1 has to be fitted with the healds 8. For this purpose, the latter are slid onto the shaft staves 6, 7 from their ends. This manipulation occurs in the absence of at least the lower damping element 12, but preferably in the absence of both damping elements 12, 13. Thereafter the warp threads are threaded into the healds 8, that is, into their thread eyelet by means of a thread inserting machine. The warp threads have the tendency to extend in a linearly taut manner. As a result, they cause alignment of the healds 8, which sit with a large play on the shaft staves 6, 7, until the healds 8 have found their working position on the respective shaft staves 6, 7. At this point the damping elements 12, 13 may be inserted by sliding them, for example, with a certain elastic deformation, over the sheet metal securing members 27 to 33, into the buffer chamber 21 in which they will then loosely lie. In the alternative, the damping elements 12, 13 may be axially drawn in. As a further alternative, it is feasible to releasably connect, for example, by screws, the sheet metal securing members 27 to 33 with the carrier body 15. In such a case the sheet metal securing members 27 to 33 may be removed for facilitating the insertion of the damping elements 12, 13. In case of sufficient flexibility, the damping elements 12, 13 may also be introduced into the buffer chamber 21 through the gaps between the sheet metal securing elements 27 to 33.

After completion of the outfitting of the heald shaft 1, the weaving machine may start its normal operation, during which the heald shaft 1 is reciprocated very rapidly and with very abrupt motions in the direction of the arrow 14 (FIG. 1). The healds 8, moving together with the heald shaft 1, have to be braked to a stop and then accelerated each time at the upper and lower reversal points of the heald shaft 1. Due to gravity and the weight of the damping element 12, the upper damping element, designated at 12 in FIG. 1, lies directly on the associated end eyelets 9 of the healds 8. Thus, the damping element has a quieting, oscillation-absorbing and damping effect. At the points of reversal of the direction of motion of the heald shaft, the damping element 12, 13 impacts on the engagement surface 26, whereby the motion of the damping element is limited. The healds 8 which follow the damping element 12, 13 are then caught relatively softly by partially penetrating into the soft damping material and are thereafter again accelerated in the opposite direction. During the braking process, the healds 8 push the damping element 12 or 13 in front of themselves and are damped thereby already at that point. Then they impact with the damping element 12, for example, on the engagement surface 26 and are braked there to a full stop. Such a braking process which initiates the change in the direction of motion, proceeds with less oscillation and softer than in case of a fixed support of the damping element 12, for example, at the engagement surface 26. It is of importance in a shaft rod according to the invention, provided with movable damping strips 12, 13, that the healds 8 are entrained by the shaft staves 6, 7, that is, they are pulled, in which case at the points of reversal of the direction of motion the damping elements 12, 13 assume, preferably for a short period, a pushing function due to their elasticity.

Figure 5:
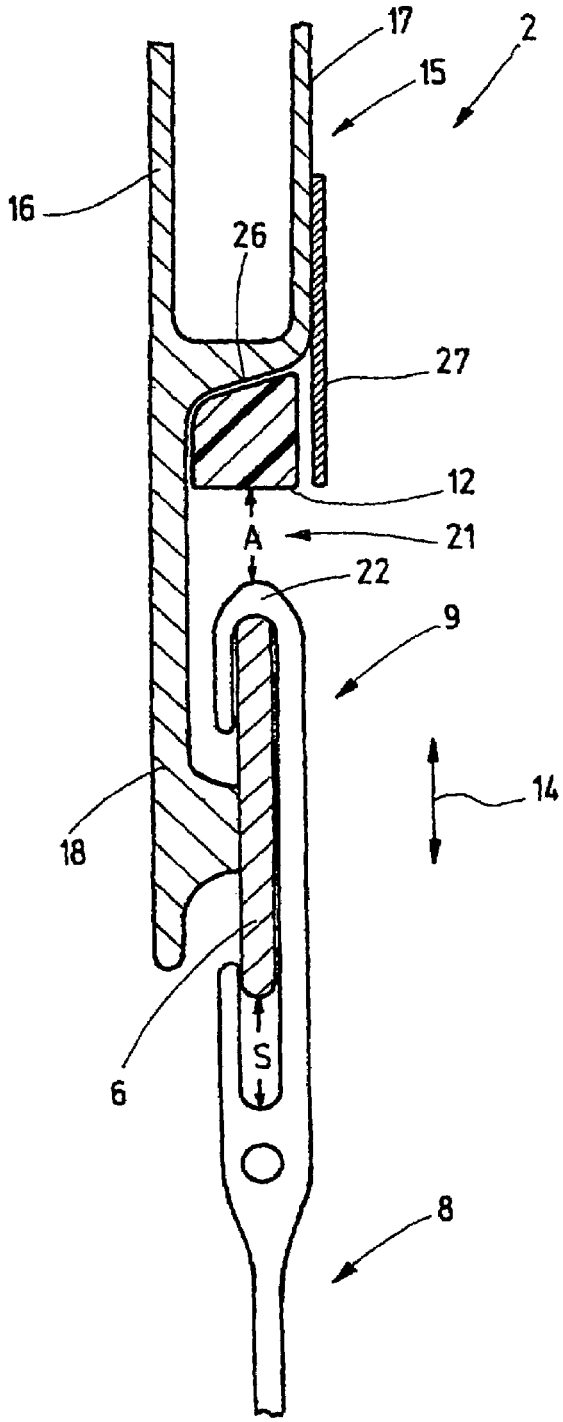
FIGS. 5 and 6 are schematic, fragmentary cross-sectional illustrations of a modified embodiment of a shaft rod having a movable damping element shown in different positions.
Figure 6:
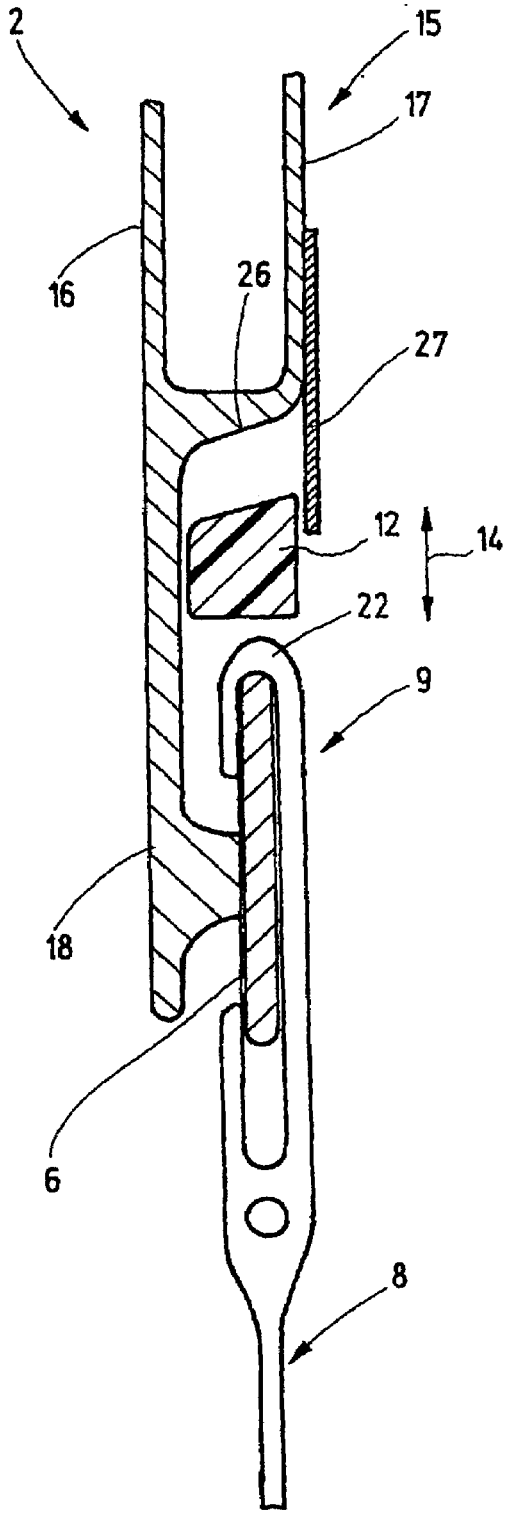

In FIGS. 5 and 6 the shaft rod 2 has a modified shaft stave 6 and likewise, the healds 8 have modified end eyelets 9. The latter surround the shaft stave 6 in a C-shaped manner. The play of the healds 8 in the longitudinal heald direction is obtained from the difference of the height of the shaft stave 6 measured in the longitudinal heald direction (arrow 14) and the inner width of the end eyelet 9 measured in the same direction. Such a play S is greater than the maximum distance A between the damping element 12 and the head 22. The distance A is obtained as the difference between the height of the buffer chamber 21 and the height of the damping element 12. The height of the buffer chamber 21 is obtained from the distance measured from the engagement surface 26 to the outer edge of the head 22 of the end eyelet 9, 11. As shown in FIG. 6, the damping element 12 may freely move in the working direction (arrow 14) in the buffer chamber 21 and may arrive into engagement with the engagement surface 26 as well as the head 22. During operation of the weaving machine, as the heald shaft 1 executes an oscillating motion in the direction of the arrow 14, the damping element and the healds 8 perform jointly a reciprocating motion, while they are, to a large measure, in engagement with one another, resulting in the above-described damping effect for this embodiment as well.

Figure 7:
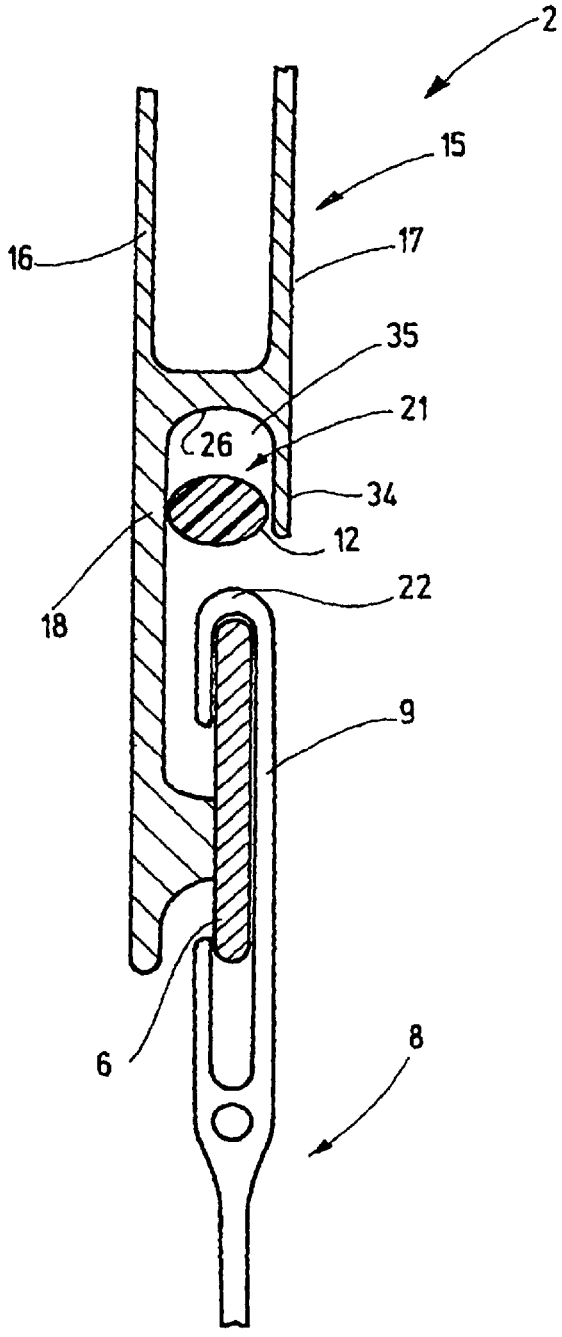
FIG. 7 is a schematic, fragmentary cross-sectional view of a further modified embodiment of a shaft rod having a round, movably supported damping element.

FIG. 7 illustrates a further modified embodiment of the shaft rod 2. This embodiment is based to a large measure on the embodiment of FIGS. 5 and 6 and thus the previous description accordingly applies. The figure description of FIGS. 1 to 4 applies complementally.

In this instance, the damping element 12 has a circular cross section and again, is of a damping material. It is, for example, formed by a plastic bar, a rubber bar or the like. In the carrier body 15 the engagement surface 26 is formed which, in this embodiment, is constituted by a rounded trough. The engagement surface 26, together with a flat, wall-like rib 34 which extends parallel to the securing web 18, forms a receiving chamber for the damping element 12. The receiving chamber is part of the buffer chamber 21. In this embodiment, similarly to the previously described embodiments, a certain play is present between the securing web 18 and the frontal securing elements (the sheet metal securing elements 27 to 33) which are here replaced by the rib 34 which extends uninterruptedly in the longitudinal direction of the shaft rod 2.

By virtue of the above arrangement, between the engagement surface 26 and the damping element 12 an air cushion is enclosed which may develop a certain buffering effect. The damping element 12 may freely move in the buffer space 21 and thus it may engage the head 22 or, in the alternative, the engagement surface 26. In case the shaft rod 2 moves rapidly, the damping element 12 first lies on the head 22. Upon abrupt braking of the shaft rod 2, as it occurs during a change in the direction of motion, the damping element 12 and the healds 8, with their end eyelets 9, 11, penetrate into the buffer chamber 21, as a result of which the air cushion 35 is displaced. The latter then must escape past the damping element 12; this has a damping and thus an impact-reducing effect, particularly in case of very rapid braking steps.

It is further feasible to provide the rib 34, for purposes of controlling the escaping air cushion 35 or for saving weight, with apertures or interruptions in the shape of groove-like or slot-like milled-out portions.

Figure 8:
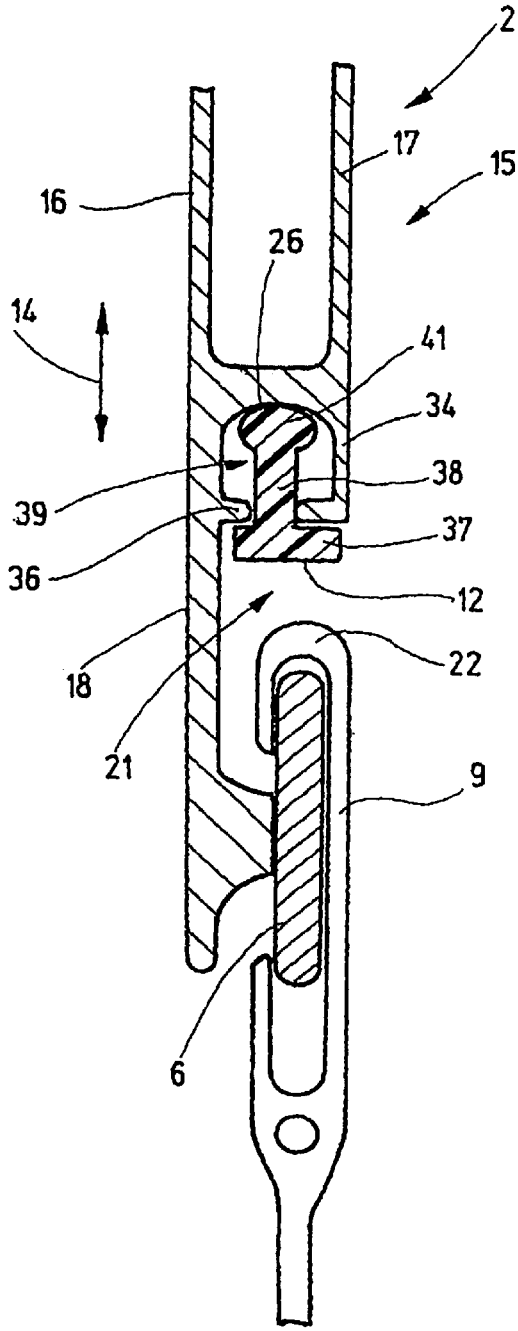
FIG. 8 is a schematic, fragmentary cross-sectional view of an embodiment of a shaft rod having a form-fittingly held, movably supported damping element.

FIG. 8 illustrates a further modified embodiment of the shaft rod 2. The previous description concerning the same reference numerals applies to this embodiment. In this case, however, the rib 34 is, at its free end, slightly bent inward toward the securing web 18. The latter has, at a corresponding location, a rib-like projection 36 which bounds a slot with the rib 34. The slot is open toward the shaft stave 6 and lies with the latter preferably in the same plane. The slot, however, may be slightly offset, as shown.

The damping element 12 is in this instance a profile element having a damping cushion 37 which is joined by a web 38 passing through the slot. The web 38 extends perpendicularly from the damping cushion 37 into an inner chamber 39 surrounded, on the one hand, by the rear wall 18 and, on the other hand, by the rib 34. The inner chamber 39 is closed at the top by the engagement surface 26 which is engaged by a bead-like head region 41 formed at the free end of the web 38.

The damping element 12 has a play measured in the working direction (arrow 14). The range of play of the damping element 12 intersects—like in all the other previously described embodiments—the range of play of the end eyelet 9, that is, the damping element 12 and the head 22 may be in engagement with one another in any position inside the buffer chamber 21. In this embodiment too, as in the embodiment according to FIG. 7, a pneumatic damping effect may be obtained in addition to the mechanical damping.

Figure 9:
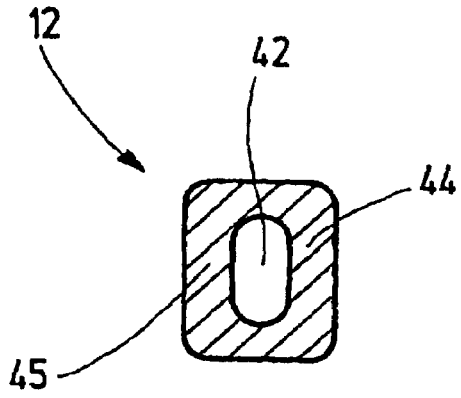
FIGS. 9 and 9*a* are schematic cross-sectional views of a modified embodiment of a damping element.
Figure 9A:
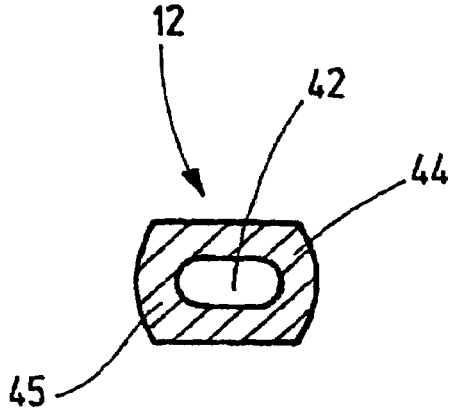

FIG. 9 shows a damping element 12 in which a certain mobility is ensured by means of a hollow chamber 42. This damping element 12 may find application in the shaft rod configurations of FIGS. 3, 4, 5, 6 and others; therefore, the earlier description applies accordingly. In case of a suitable flexibility of the damping element 12, the distance between the damping element 12 and the head 22 of the heald 8 may be reduced to zero. This, however, is not necessary. A reduction of the distance between the damping element 12 and the head 22 of the heald 8 to zero means that the damping strip 12 lies continuously on the heald 8 and thus damps the latter during the upward and downward motions. It further means that the damping element 12 is compressed at the points of reversal of the direction of motion as the hollow chamber 42 (FIG. 9*a*) undergoes deformation, and the originally approximately parallel side walls 44, 45 are pushed outward to assume an arcuate shape.

Figure 10:
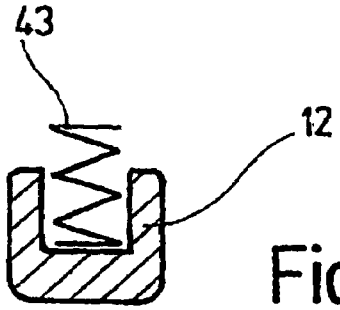
FIG. 10 is a schematic cross-sectional view of a further, modified embodiment of a damping element.

FIG. 10 illustrates a modified shape of a damping element 12 which is pressed by a spring force 43 in the direction of the heald 8. In this embodiment too, as in case of the damping element 12 of FIGS. 9, 9*a*, it is possible to reduce the distance between the damping element 12 and the head 22 of the heald 8 to zero which, however, is not a requirement for the inventive shaft rod. According to the invention, this damping strip too, lies on the head 22 by virtue of its own weight and inertia and thus damps the heald 8 during its upward and downward motions. In case the distance between the damping element 12 and the head 22 of the heald 8 is less than the play of the heald 8 on the shaft staves 6, 7, the heald 8 is damped at the reversal points of the direction of motion by the spring force 43. Such a spring force may be applied by various spring means. The damping effect is increased if the damping element 12 lies on the heald 8 with a bias exerted by the spring force. The damping element 12 according to FIG. 10 may find application in the shaft rod configurations of FIGS. 3, 4, 5, 6 and others. The springs 43 may be short and thus may be supported with a play in their position of rest for rendering them active solely at the points of reversal.

Figure 11:
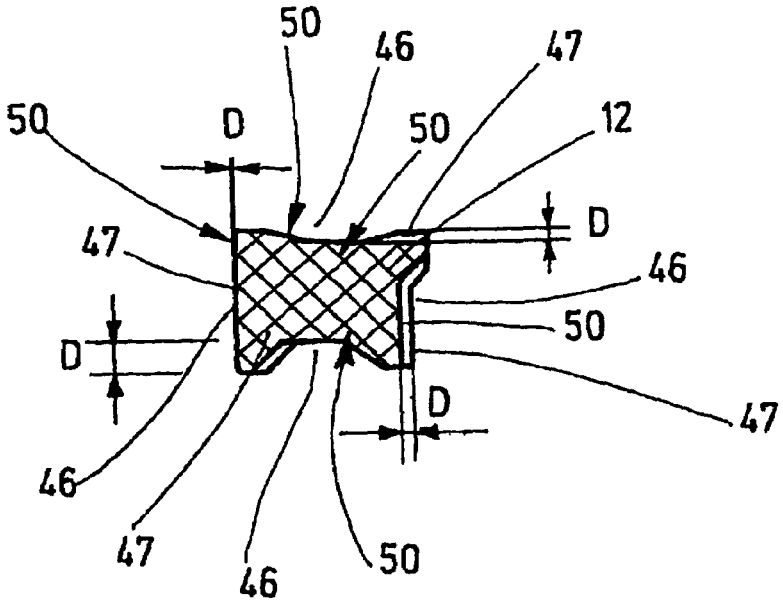
FIG. 11 is a schematic cross-sectional view of a further, modified embodiment of a damping element.

FIG. 11 shows a damping element 12 with which different damping effects may be obtained dependent on its inserted position. This damping element 12 too, is movably supported in the buffer chamber 21 and lies on the head 22 of the heald 8 by virtue of gravity, so that the damping element 12 damps the heald 8 during the upward and downward movements of the heald shaft 1. At the points of reversal of the direction of motion of the healds 8, the damping effect is, by using a damping element 12 according to FIG. 11, dependent from the installed position of the damping element 12. For obtaining different damping effects, the rectangular damping element 12 includes damping regions 50 which, in this embodiment, are formed on the outer surfaces 47 as recesses 46, such as troughs which may have different depths. The shape of the trough 46 is adapted to the shape of the end of the head 22 of the heald 8 or is slightly larger. During the motion course, at the time when the damping element 12 is in engagement with the engagement surface 26, the depth D of the troughs 46 defines the moment at which the head 22 of the heald 8 tries to penetrate into the damping element 12. This is the phase during which a damping starts by virtue of the elasticity of the damping strip 12. Such an elasticity is determined by the material properties of the damping strip 12 and/or by its shape. If, for example, the depth D of the trough 46, which is in contact with the engagement surface 26, is zero, the damping is affected essentially only by the material properties of the damping element 12. If, on the contrary, the depth D is very substantial, corresponding, for example, to one half of the height of the damping element 12, the damping is preponderantly determined by the shape of the damping element 12. The troughs of the damping element 12 may have different depths, so that different damping effects may be obtained dependent on the installed position.

A heald shaft 1 comprises at least one shaft rod 2 on which a damping element 12 is supported to be movable in the longitudinal direction of the heald. By virtue of movably supporting the damping element 12, an alignment of the healds 8 is improved and facilitated, and a desired damping effect is obtained during the entire motion course of the healds 8.

LIST OF REFERENCE CHARACTERS:

| | |
|---|---|
| 1 | heald shaft |
| 2, 3 | shaft rod |
| 4, 5 | end binders |
| 6, 7 | shaft stave |
| 8 | healds |
| 9, 11 | end eyelets |
| 12, 13 | damping element, heald damping element |
| 14 | arrow (for the working direction) |
| 15 | carrier body |
| 16, 17 | side walls |
| 18 | securing web |
| 19 | projection |
| 21 | buffer chamber |
| 22 | head |
| 23 | longitudinal recess |
| 24 | holding lug |
| 26 | engagement surface |
| 27 to 33 | sheet metal securing members |
| 34 | rib |
| 35 | air cushion |
| 36 | projection |
| 37 | damping cushion |
| 38 | web |
| 39 | inner chamber |
| 41 | head region |
| 42 | hollow space |
| 43 | spring element |
| 44, 45 | side wall |
| 46 | recess, trough |
| 47 | outer surface |
| A | distance |
| H | stroke |
| S | play |
| D | depth |

The invention claimed is:

1. A shaft rod for a heald shaft of a weaving machine, including a carrier body which carries a shaft stave or on which a shaft stave is formed, at least one heald damping element supported on the carrier body, and, wherein the heald damping element is supported on the carrier body to be movable transversely to the carrier body, and in the longitudinal direction of a heald mounted on the shaft stave, between an abutment surface of the carrier body of the shaft rod and an outer end surface of an eyelet of a heald mounted on the shaft stave of the carrier body.

2. The shaft rod as defined in claim 1, wherein the heald damping element is supported to be movable in the longitudinal heald direction.

3. The shaft rod as defined in claim 1, wherein the shaft stave is structured such that the healds are supported on the shaft stave with a play (S) in the longitudinal heald direction.

4. The shaft rod as defined in claim 1, wherein for movably supporting the damping element, a support is provided which allows a displacement of the entire damping element in a position near the shaft stave and a counter motion of the damping element in a position remote from the shaft stave.

5. The shaft rod as defined in claim 1, wherein the damping element is supported in a chamber formed in the carrier body into which the damping element penetrates during its motion away from the shaft stave while displacing air.

6. The shaft rod as defined in claim 1, wherein the damping element is longitudinally displaceably supported.

7. The shaft rod as defined in claim 1, wherein the damping element is frictionally held for assisting the damping.

8. The shaft rod as defined in claim 1, wherein the damping element is form-fittingly held with play.

9. The shaft rod as defined in claim 1, wherein the damping element is formed of a yielding material.

10. The shaft rod as defined in claim 1, wherein the damping element has a deformable interior hollow space.

11. The shaft rod as defined in claim 1, the damping element is displaceably supported against a spring force.

12. The shaft rod as defined in claim 1, wherein the damping element has at least two outer surfaces which have unlike shapes.

13. The shaft rod as defined in claim 1, wherein the damping element has at least two damping regions which damp differently from one another.

14. A heald shaft having a shaft rod as defined according to claims 1.

15. A method of fitting a heald shaft with healds and/or threading threads into the healds, comprising performing the fitting step and/or the threading step on a heald shaft; with the damping element for the healds from at least one shaft rod of the heald shaft having been removed, and, after completing the fitting and/or the threading step, mounting the damping element on the shaft rod between an outer end surface of the healds and a surface of the shaft rod for movement in a longitudinal direction of the healds.

* * * * *